US010851530B1

(12) United States Patent
Zhang

(10) Patent No.: US 10,851,530 B1
(45) Date of Patent: Dec. 1, 2020

(54) SINK FLUSHER AND NOVEL SINK

(71) Applicant: Zhejiang Rosun Kitchen & Bath Technology Co., Ltd., Zhejiang (CN)

(72) Inventor: Jin Zhang, Zhejiang (CN)

(73) Assignee: Zhejiang Rosun Kitchen & Bath Technology Co., Ltd., Zhejiang (CN)

( * ) Notice: Subject to any disclaimer, the term of this patent is extended or adjusted under 35 U.S.C. 154(b) by 0 days.

(21) Appl. No.: 16/446,623

(22) Filed: Jun. 20, 2019

(51) Int. Cl.
*E03C 1/182* (2006.01)

(52) U.S. Cl.
CPC ..... *E03C 1/182* (2013.01)

(58) Field of Classification Search
CPC ..... E03C 1/182; E03C 1/18; E03C 1/14
USPC ..... 4/619
See application file for complete search history.

(56) References Cited

U.S. PATENT DOCUMENTS

2005/0097668 A1* 5/2005 Rothney ..... E03C 1/18 4/619
2007/0011806 A1* 1/2007 Knowlton ..... E03C 1/18 4/619
2007/0056092 A1* 3/2007 Prather ..... E03C 1/048 4/619
2007/0174958 A1* 8/2007 McKay, Jr. ..... E03C 1/048 4/619

* cited by examiner

*Primary Examiner* — Huyen D Le
(74) *Attorney, Agent, or Firm* — JCIP Global Inc.

(57) ABSTRACT

A novel sink includes a sink body and a sink flat. The sink body comprises a bottom wall and a sink wall extending upward from and surrounding the bottom wall, an annular water flow channel is provided at a top portion of the sink wall, the annular water flow channel is provided with at least one water inlet hole communicated with an external water inlet pipe, and the bottom wall is provided with a drain hole. The sink flat is arranged above the sink body and comprises an annular flange panel and an insert portion extending downward along an inner wall of the flange panel, the insert portion extends into the sink body, an annular water outlet communicated with the water flow channel is formed between the insert portion and the sink wall, and the annular water outlet sprays water along an inner wall of the sink wall.

15 Claims, 5 Drawing Sheets

SINK FLUSHER AND NOVEL SINK

BACKGROUND

Technical Field

The invention relates to the field of kitchen utensils, in particular to a sink flusher and a novel sink.

Description of Related Art

A sink is an appliance for holding a large amount of water for cleaning articles, widely used in kitchens, hospitals, laboratories, and various production workshops. The existing sink is very simple in structure, including a bottom wall and a side wall, with a drain hole at the bottom wall. In the case of a kitchen sink, since tableware and the like usually contain much greasy dirt which adheres to the wall of the sink during cleaning, each time a user washes tableware, the sink needs to be cleaned independently, causing inconvenience. Similarly, for hospitals, laboratories, and production workshops, chemicals tend to adhere to the side wall of the sink. In the existing sink structure, it is also very inconvenient to clean the side wall.

SUMMARY

The invention provides a sink flusher capable of automatically cleaning the sink wall and a novel sink, aiming at overcoming the problem that the existing sink is inconvenient to clean.

To achieve the above object, the present invention provides a novel sink including a sink body and a sink flat. The sink body includes a bottom wall and a sink wall extending upward from and surrounding the bottom wall, an annular water flow channel is provided at a top portion of the sink wall, the annular water flow channel is provided with at least one water inlet hole communicated with an external water inlet pipe, and the bottom wall is provided with a drain hole. The sink flat is arranged above the sink body and includes an annular flange panel and an insert portion extending downward along the inner wall of the flange panel, the insert portion extends into the sink body, an annular water outlet communicated with a water flow channel is formed between the insert portion and the sink wall, and the annular water outlet sprays water along the inner wall of the sink wall.

According to one embodiment of the invention, the sink wall includes a sink wall body, a trim extending outwards along a top portion of the sink wall body and a vertical connecting wall formed at a tail end of the trim, the trim and the vertical connecting wall form the annular water flow channel, and the trim or the vertical connecting wall is provided with the water inlet hole.

According to one embodiment of the invention, a section line of the trim in a direction of a centerline of the sink body is an arc-shaped curve or an inclined straight line.

According to one embodiment of the invention, at the top portion of the sink wall, the outer side wall of the sink wall extends upward relative to an inner side wall of the sink wall, the annular water flow channel is formed between the inner side wall and the outer side wall, an arc transition curved surface or an inclined guide surface is formed between the inner side wall and the outer side wall, and the water inlet hole is formed in the outer side wall.

According to one embodiment of the invention, the insert portion extends downward in a vertical direction; alternatively, in the insertion direction, the insert portion is gradually inclined toward a side where the sink wall is located.

According to one embodiment of the present invention, when the insert portion is inserted into the sink body, a tail end of the insert portion extends downward through the annular water flow channel, and the annular water outlet is formed between the insert portion and the sink wall below the annular water flow channel.

According to one embodiment of the invention, the water inlet hole is obliquely arranged in the sink wall, and a water inlet direction of the water inlet hole is obliquely upward.

According to one embodiment of the invention, the sink flat further comprises a block arranged opposite to the water inlet hole, and the block blocks water flowing out of the water inlet hole into the annular water flow channel or the annular water outlet.

According to one embodiment of the invention, the block is formed between a flange panel and the insert portion, and a section line of the block in a direction of a centerline of the sink body is a convex arc-shaped curve or an inclined straight line.

According to one embodiment of the invention, the flange panel is seamlessly welded to the sink wall.

The invention also provides a sink flusher which is annular and includes an inner wall, an outer wall and a water inlet pipe. The outer wall is arranged on an outer side of the inner wall, an upper end of the outer wall is connected with an upper end of the inner wall, a lower end of the outer wall is separated from a lower end of the inner wall, the lower end of the inner wall extends over the lower end of the outer wall, and an annular water flow channel is formed between the inner wall and the outer wall. The water inlet pipe is formed on the inner wall or the outer wall and communicated with the annular water flow channel.

According to one embodiment of the invention, a section line of the inner wall in a direction of a centerline of the sink flusher is an arc-shaped curve or an inclined straight line.

According to one embodiment of the invention, the lower end of the inner wall extends downward in the vertical direction; or in an extending direction, the lower end of the inner wall is gradually inclined towards a side where the outer wall is located.

The invention also provides a novel sink, including a sink body and a sink flusher, wherein the inner wall and the outer wall of the sink flusher are inserted into the sink body, and water in the annular water flow channel washes a side wall of the sink body.

According to one embodiment of the invention, an annular mounting groove is provided at a top portion of the sink body, the inner wall and the outer wall of the sink flusher are inserted into the annular mounting groove, the lower end of the inner wall extends through a bottom portion of the annular mounting groove, and an annular water outlet is formed between the side wall of the sink body and the inner wall.

In summary, in the novel sink provided by the invention, an annular water flow channel is provided at the top portion of the sink wall, the annular water flow channel is provided with a water inlet hole communicated with the external water inlet pipe, and the insert portion on a surface of the sink flat extends into the sink body and forms the annular water outlet with the sink wall. External water flows in the whole annular water flow channel through the water inlet hole, water is sprayed to the inner side wall of the sink wall through the annular water outlet to continuously wash residual stains on the inner side wall of the sink wall, and sewage after cleaning is discharged from the drain hole in the bottom wall, so that the automatic cleaning of the sink is realized, and very convenient in use. The annular water outlet ensures that every place on the whole sink wall can be washed clean.

In addition, the insert portion is arranged to extend in the vertical direction or the tail end of the insert portion is slightly inclined towards the sink wall, and the tail end of the insert portion extends through the annular water flow channel and forms the annular water outlet between the insert portion and the sink wall below the annular water flow channel. According to the arrangement, the tail end of the insert portion limits and guides the water flowing out of the annular water flow channel, the water flow is guided to the inner side wall of the sink wall, and the water flow continuously washes the inner side wall of the sink wall, so that the washing effect and efficiency are greatly improved, with the water saved.

In order to render the above and other objects of the present invention, features and advantages to be clearer and more comprehensible, preferred embodiments are provided below particularly, in conjunction with accompany drawings, to describe in detail.

DESCRIPTION OF THE EMBODIMENTS

Figure 1:
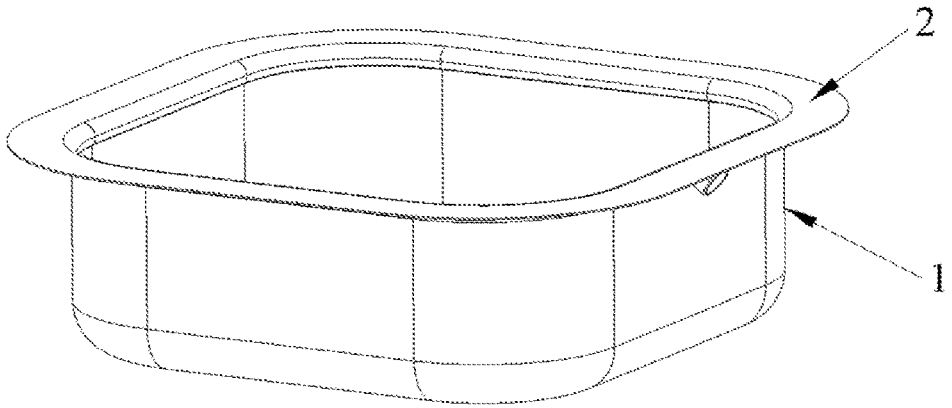
FIG. 1 is a schematic view showing a structure of a novel sink according to an embodiment of the present invention.
Figure 2:
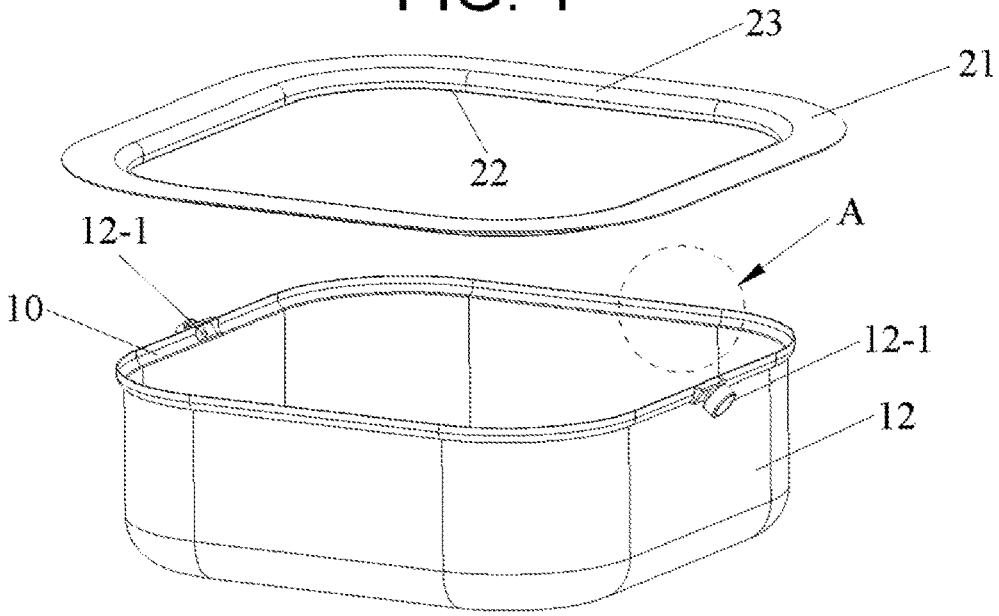
FIG. 2 shows an exploded view of FIG. 1.
Figure 3:
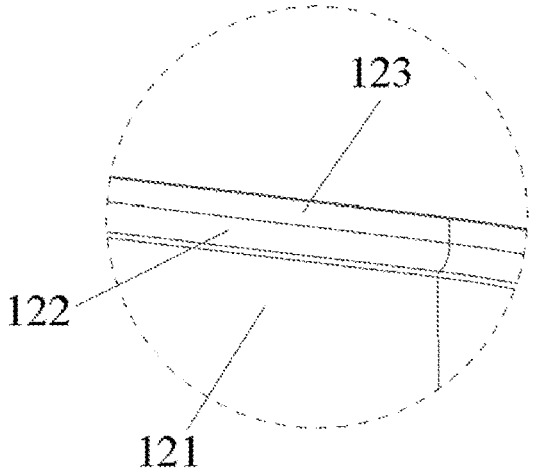
FIG. 3 is an enlarged schematic view at A in FIG. 2.

As shown in FIG. 1, a novel sink provided by the embodiment comprises a sink body 1 and a sink flat 2. The sink body 1 comprises a bottom wall 11 and a sink wall 12 extending upward from and surrounding the bottom wall 11, an annular water flow channel 10 is provided at a top portion of the sink wall 12, the annular water flow channel 10 is provided with at least one water inlet hole 12-1 communicated with an external water inlet pipe, and the bottom wall 11 is provided with a drain hole 11-1. The sink flat 2 is arranged above the sink body 1 and comprises an annular flange panel 21 and an insert portion 22 extending downward along the inner wall of the flange panel 21, the insert portion 22 extends into the sink body 1, an annular water outlet 20 communicated with a water flow channel is formed between the insert portion 22 and the sink wall 12, and the annular water outlet 20 sprays water along the inner wall of the sink wall 12.

The embodiment provides a novel sink, wherein a water inlet electromagnetic valve is arranged on the external water inlet pipe in the novel sink, and a control plate (not shown in the drawings due to a visual angle) for controlling the water inlet electromagnetic valve is arranged below the annular flange panel 21. A user opens the water inlet electromagnetic valve through the control panel, and water flows into the annular water flow channel through the water inlet pipe. However, the present invention is not limited thereto. In other embodiments, the external water inlet pipe may be directly connected to a faucet and the user may control the water inlet by manually turning on or off the faucet.

In addition, since oil stains are the major adherent to the sink, in order to better remove the oil stains, a three-way pipe can be additionally arranged on the external water inlet pipe, a first branch pipe of the three-way pipe is communicated with the water inlet pipe, clean clear water is circulated in a second branch pipe, water doped with detergent is circulated in a third branch pipe, and water inlet electromagnetic valves are respectively arranged on the second branch pipe and the third branch pipe. During cleaning, a user may open the water inlet electromagnetic valve on the third branch pipe through the control panel, and water with detergent washes an inner side wall of the sink wall 12 to dissolve and wash adhered oil stains. And then the user may close the water inlet electromagnetic valve on the third branch pipe, open the water inlet electromagnetic valve on the second branch pipe, and clean the inner side wall of the sink wall 12 with clean clear water.

In this embodiment, the sink wall 12 includes a sink wall body 121, a trim 122 extending outwardly along a top portion of the sink wall body 121, and a vertical connecting wall 123 formed at a tail end of the trim 122, the trim 122 and the vertical connecting wall 123 forming the annular water flow channel 10. However, the present invention is not limited thereto. In other embodiments, in the case where a thickness of the sink wall is relatively thick, the sink wall can be arranged at the top portion of the sink wall, an outer side wall of the sink wall extends upward relative to the inner side wall of the sink wall, an annular water flow channel is formed between the inner side wall and the outer side wall, an arc transition curved surface or an inclined guide surface is formed between the inner side wall and the outer side wall, and the water inlet hole is formed in the outer side wall.

In this embodiment, a section line of the trim 122 in a direction of a centerline of the sink body is an arc-shaped curve, the water inlet holes 12-1 are formed in the trim 122 and the vertical connecting wall 123, and there are two of them. However, the present invention is not limited thereto. In other embodiments, the water inlet hole can be formed only in the vertical connecting wall or only on the trim; the number of water inlet holes may also be one or more than three. The configuration of arc-shaped curve may, on one hand, guide water entering the annular water flow channel 10 to the annular water outlet 20, and on the other hand, extend a water flow distance between the water inlet hole 12-1 and the annular water outlet 20 closest to the water inlet hole 12-1, and the water entering from the water inlet hole 12-1 flows to a circumferential direction of the annular water flow channel 10 while flowing to the closest annular water outlet 20, so that the water can fill the whole annular water flow channel 10. However, the present invention is not limited thereto. In other embodiments, the section line of the trim in the direction of the centerline of the sink body may also be an inclined straight line. In this case, a plurality of water inlets are required to be formed, so that the water let in can fill the whole annular water flow channel.

Figure 4:
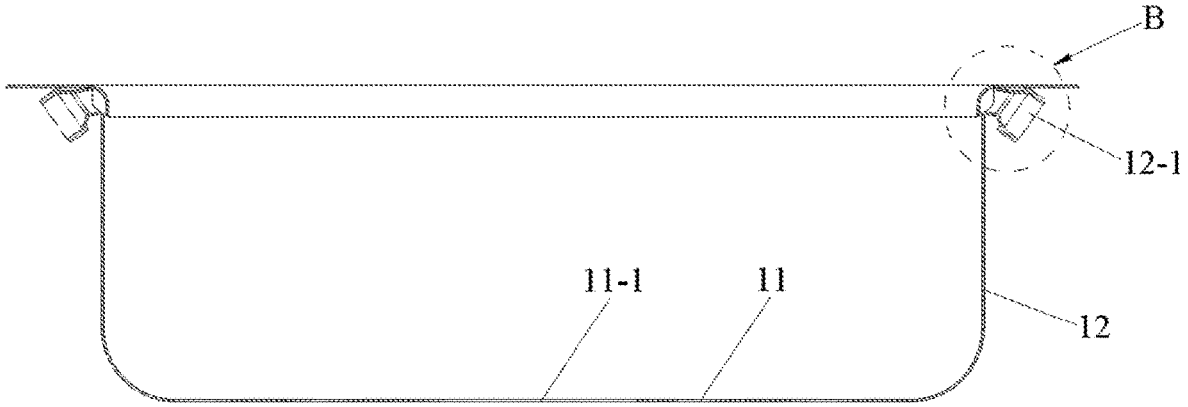
FIG. 4 is a cross-sectional view of FIG. 1.
Figure 5:
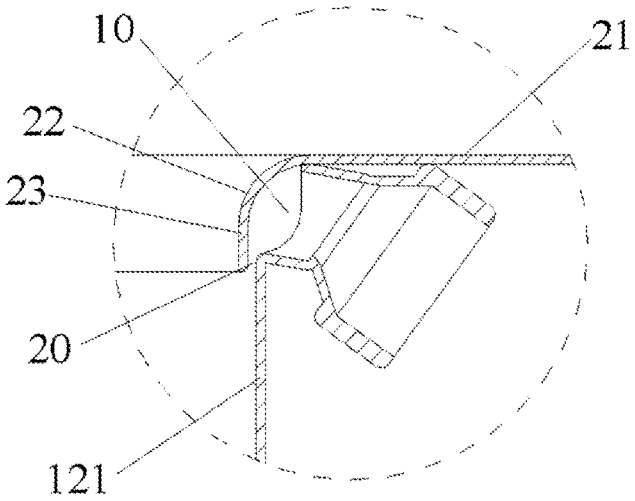
FIG. 5 is an enlarged schematic view at B in FIG. 4.
Figure 6:
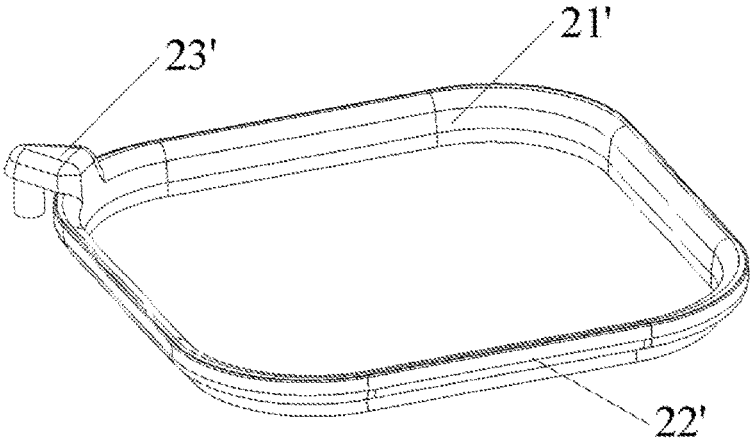
FIG. 6 is a schematic view showing a structure of a sink flusher provided in another embodiment of the present invention.

Further, as shown in FIG. 4 and FIG. 5, the water inlet hole 12-1 is obliquely arranged in the trim 122 and the vertical connecting wall 123, and a water inlet direction of the water inlet hole 12-1 is obliquely upward. This arrangement also extends the water flow distance between the inlet hole 12-1 and the closest annular outlet 20, and water can better flow along the annular water flow channel 10. Since the water inlet direction is obliquely upward, in order to prevent a part of the water from flowing downward along a surface of the insert portion 22, the sink flat 2 is further provided with a block 23 arranged opposite to the water inlet hole, and the block 23 blocks the water flowing out of the water inlet hole into the annular water flow channel 10 or the annular water outlet 20. In this embodiment, as shown in FIG. 5, the block 23 is connected between the inner wall of the flange panel 21 and the insert portion 22, the section line of the block 23 in the direction of the centerline of the sink body is a convex arc-shaped curve, the arc-shaped inner wall of the block 23 blocks and reflects the water sprayed from the water inlet hole 12-1, and blocks the water into the annular water flow channel 10 or the annular water outlet 20 as much as possible. Thereby, the water can flow along the inner side wall of the sink wall 12, improving the washing effect. However, the present invention is not limited thereto. In other embodiments, the section line of the block in the direction of the centerline of the sink body may also be an inclined straight line.

In this embodiment, the block 23 is formed in the circumferential direction of the entire flange panel 21. However, the present invention is not limited thereto. In other embodiments, the insert portion may be directly connected to the inner wall of the flange panel, a block may be added only at a position corresponding to the water outlet hole, and no block may be provided at other positions.

In this embodiment, as shown in FIG. 5, the insert portion 22 extends in a vertical direction. When the insert portion 22 is inserted into the sink body 1, the tail end of the insert portion 22 extends through the annular water flow channel 10, and an annular water outlet 20 communicated with the water flow channel is formed between the insert portion 22 and the sink wall below the annular water flow channel 10. The tail end of the insert portion 22 extends through the water flow channel 10, and the insert portion 22 can block and guide the water flowing out of the water flow channel 10 to the inner side wall of the sink wall 12, so that the water flows along the inner side wall of the sink wall 12 as much as possible, thereby not only greatly improving the washing effect, but also saving the water for washing. In addition, the vertically extending insert portion 22 can be well inserted into the sink body 1 during assembly, and the assembly is very convenient. However, the present invention is not limited thereto. In other embodiments, the stainless steel material or other material has some flexibility in the case where the thickness of the insert portion is relatively thin, and the tail end of the insert portion may be disposed slightly inclined to the direction of the sink wall.

In this embodiment, the flange panel 21 is seamlessly welded to the vertical connecting wall 123. However, the present invention is not limited thereto.

Another Embodiment

As shown in FIG. 6 to FIG. 11, the present embodiment provides a sink flusher 2' comprising an inner wall 21', an outer wall 22', and a water inlet pipe 23'. The outer wall 22' is disposed outside the inner wall 21' and an upper end of the outer wall 22' is connected to an upper end of the inner wall 21', a lower end of the outer wall 22' is separated from a lower end of the inner wall 21' and the lower end of the inner wall 21' extends over the lower end of the outer wall 22', and an annular water flow channel 10' is formed between the inner wall 21' and the outer wall 22'. A water inlet pipe 23' is formed at the inner wall 21' or the outer wall 22' and communicates with the annular water flow channel 20'.

Figure 7:
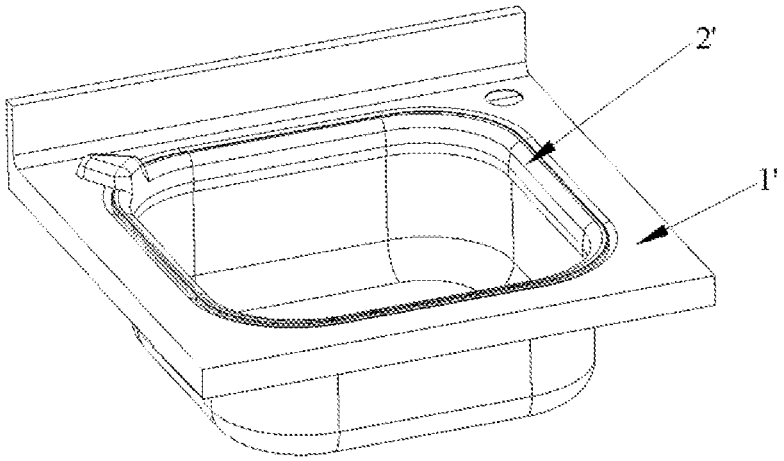
FIG. 7 is a schematic view showing a structure of a novel sink provided by the another embodiment of the present invention.
Figure 8:
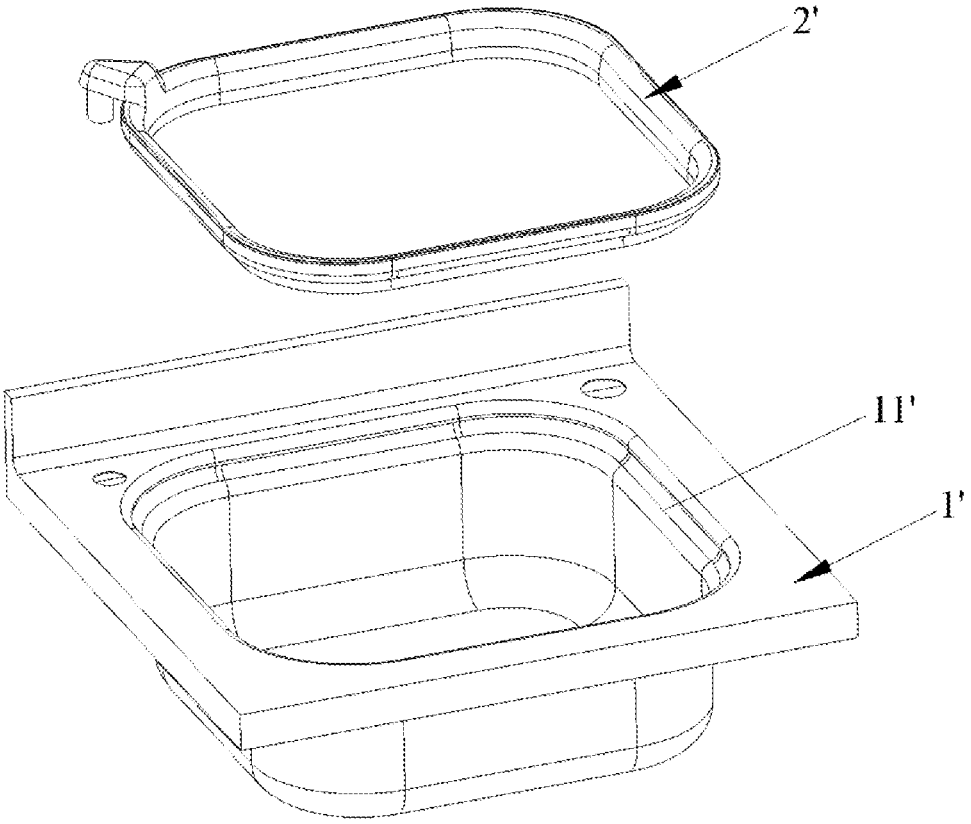
FIG. 8 is an exploded view of FIG. 7.
Figure 9:
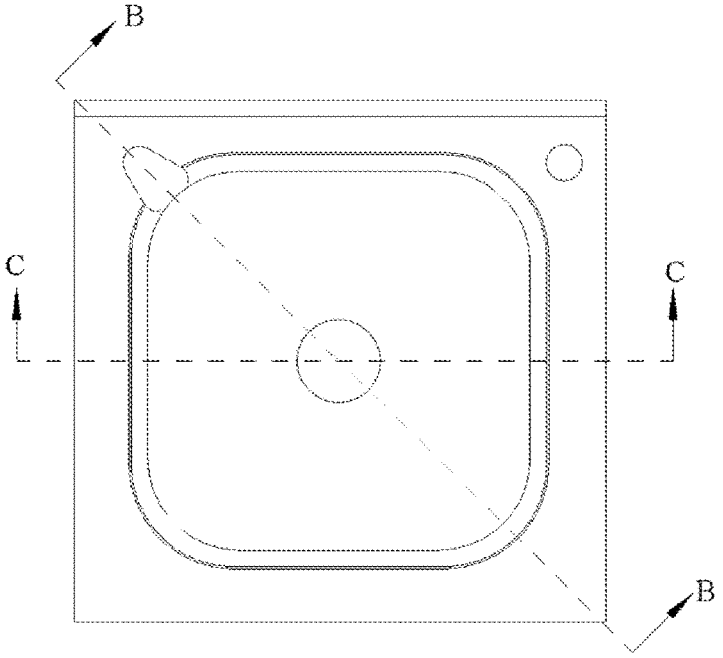
FIG. 9 is a schematic view showing the structure of FIG. 7 from another perspective.
Figure 10:
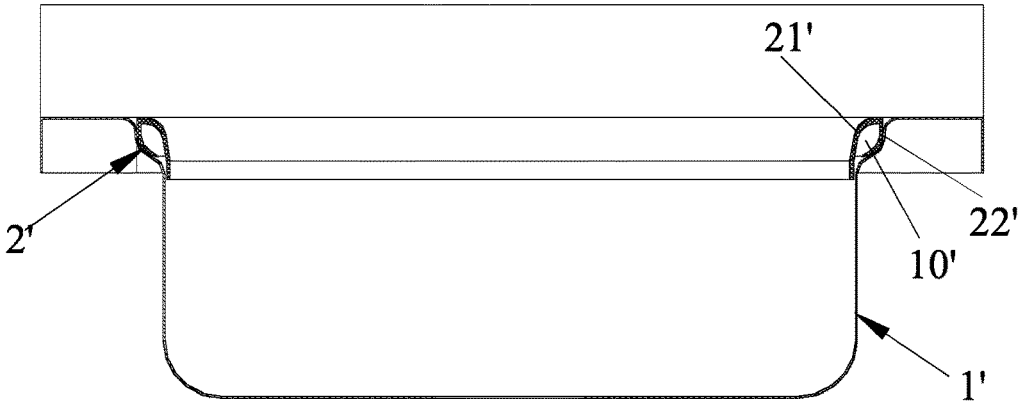
FIG. 10 is a cross-sectional view taken along line B-B of FIG. 9.
Figure 11:
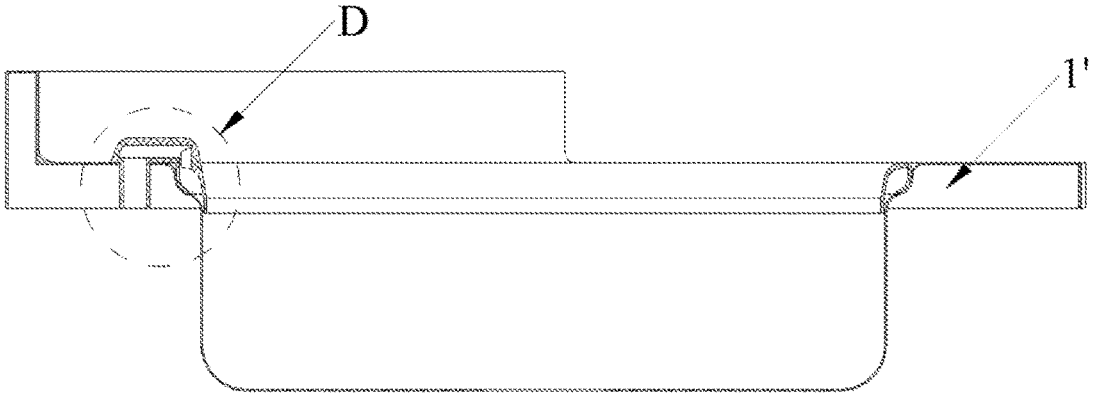
FIG. 11 is a cross-sectional view taken along line C-C of FIG. 9.
Figure 12:
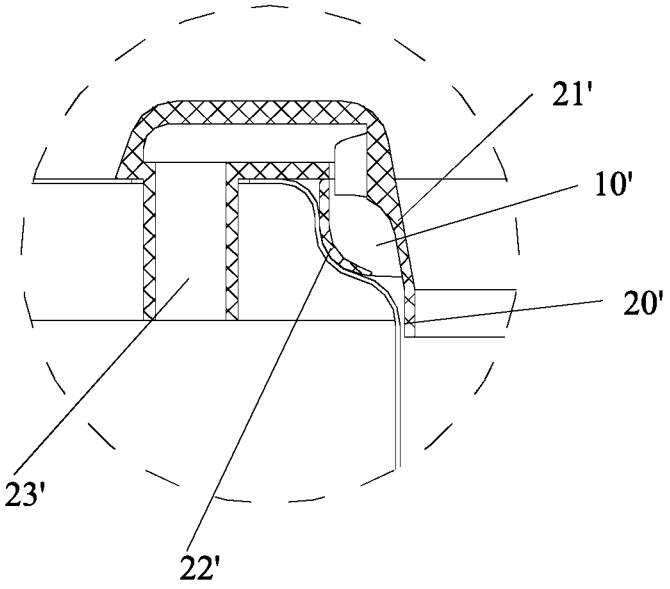
FIG. 12 is an enlarged schematic view at area D in FIG. 11.

In this embodiment, as shown in FIG. 7, the water inlet pipe 23' is connected to the inner wall 21' and the outer wall 22', respectively. However, the present invention is not limited thereto in any way. In other embodiments, the inlet pipe may be connected directly to the outer wall.

The sink flusher 2' provided by the embodiment can be assembled on an existing sink, and specifically, the inner wall 21' and the outer wall 22' of the sink flusher are inserted into a notch of the existing sink in an interference manner. The water inlet pipe 23' is connected with a faucet or communicated with water with detergent, the water flows out from the annular water outlet 20' between the lower end of the outer wall 22' and the lower end of the inner wall 21' after filling the annular water flow channel 20', continuously washes a side wall of the sink, resulting in directly washing the side wall of the sink without changing the existing sink structure, convenient in use and good in compatibility.

In this embodiment, the lower end of the inner wall 21' extends downward in the vertical direction, and the lower end of the inner wall 21' guides the water flowing from the annular water flow channel to the side wall of the sink in the vertical direction, so that the water flow can flow along the side wall of the sink as much as possible, with not only the washing effect greatly improved, but also the water for washing saved. In addition, the lower end of the vertically extending inner wall 21' can be well inserted into the sink body 1' during assembly, and the assembly is very convenient. However, the present invention is not limited thereto. In other embodiments, the lower end of the inner wall is inclined towards the side of the outer wall in the direction of extension to better direct the water flow towards the side wall of the sink.

In this embodiment, a section line of the inner wall 21' in a direction of a centerline of the sink flusher is an arc-shaped curve. On one hand, water entering the annular water flow channel 10' can be guided out through the arc-shaped curve, on the other hand, the arc-shaped curve extends the water flow distance between the water inlet pipe 23' and the annular water outlet 20' closest to the water inlet pipe 23', and water entering from the water inlet pipe 23' flows towards a circumferential direction of the annular water flow channel 10' while flowing towards the closest annular water outlet 20', so that the water can fill the whole annular water flow channel 10'. However, the present invention is not limited thereto. In other embodiments, the section line of the inner wall in the direction of the centerline of the sink flusher may also be an inclined straight line.

The embodiment further provides a novel sink corresponding to the sink flusher, wherein the novel sink comprises a sink body 1' and the sink flusher. An annular mounting groove 11' is provided at a top portion of the sink body 1', the inner wall 21' and the outer wall 22' of the sink flusher are inserted into the annular mounting groove 11', the lower end of the inner wall 21' extends beyond a bottom portion of the annular mounting groove 11', and an annular water outlet 20' is formed between the inner wall 21' and the side wall of the sink body 1'.

In this embodiment, the lower end of the inner wall 21' extends through the annular mounting groove 11' and downward in the vertical direction, and the end of the inner wall 21' blocks and guides the water flowing out of the water flow channel 10' to the side wall of the sink to better wash the side wall of the sink.

In summary, in the novel sink provided by the invention, the annular water flow channel is provided at the top portion of the wall of the sink, the annular water flow channel is provided with the water inlet hole communicated with the external water inlet pipe, and the insert portion on the sink flat extends into the sink body and forms the annular water outlet with the sink wall. External water flows to the whole annular water flow channel through the water inlet hole, water is sprayed to the inner side wall of the sink wall through the annular water outlet, residual stains on the inner side wall of the sink wall are continuously washed, and cleaned sewage is discharged from the drain hole in the bottom wall, so that automatic cleaning of the sink is realized, and is very convenient to use. The annular water outlet ensures that every place on the whole sink wall can be washed clean.

In addition, the insert portion is arranged to extend in the vertical direction or the tail end of the insert portion is slightly inclined towards the sink wall, and the tail end of the insert extends through the annular water flow channel and forms the annular water outlet between the insert portion and the sink wall below the annular water flow channel. According to the arrangement, the tail end of the insert portion limits and guides the water flowing out of the annular water flow channel, the water flow is guided to the inner side wall of the sink wall, and continuously washes the inner side wall of the sink wall, so that the washing effect and efficiency are greatly improved, and the water for washing is saved.

Although the present invention has been described in detail with reference to the preferred embodiments, it is to be understood that the present invention is not limited thereto, but it is to be understood that various changes and modifications may be made therein without departing from the spirit and scope of the present invention, which is defined in the appended claims.

What is claimed is:

1. A novel sink, comprising:

a sink body, comprising a bottom wall and a sink wall extending upward from and surrounding the bottom wall, an annular water flow channel being provided at a top portion of the sink wall, the annular water flow channel being provided with at least one water inlet hole communicated with an external water inlet pipe, and the bottom wall being provided with a drain hole; and a sink flat, arranged above the sink body and including an annular flange panel and an insert portion extending downward along an inner wall of the annular flange panel, the insert portion extending into the sink body, an annular water outlet communicated with the water flow channel being formed between the insert portion and the sink wall, and the annular water outlet spraying water along an inner wall of the sink wall.

2. The novel sink according to claim 1, wherein the sink wall comprises a sink wall body, a trim extending outward along a top portion of the sink wall body, and a vertical connecting wall formed at a tail end of the trim, the trim and the vertical connecting wall forming the annular water flow channel, and the trim or the vertical connecting wall has the water inlet hole therein.

3. The novel sink according to claim 2, wherein a section line of the trim in a direction of a centerline of the sink body is an arc-shaped curve or an inclined straight line.

4. The novel sink according to claim 1, wherein at the top portion of the sink wall, an outer side wall of the sink wall extends upward relative to an inner side wall of the sink wall, the annular water flow channel is formed between the inner side wall and the outer side wall, an arc transition curved surface or an inclined guide surface is formed between the inner side wall and the outer side wall, and the water inlet hole is formed in the outer side wall.

5. The novel sink according to claim 1, wherein the insert portion extends downward in a vertical direction; alternatively, in an insertion direction, the insert portion is gradually inclined toward a side where the sink wall is located.

6. The novel sink according to claim 5, wherein when the insert portion is inserted into the sink body, a tail end of the insert portion extends downward through the annular water flow channel, and the annular water outlet is formed between the insert portion and the sink wall below the annular water flow channel.

7. The novel sink according to claim 1, wherein the water inlet hole is obliquely arranged in the sink wall, and a water inlet direction of the water inlet hole is obliquely upward.

8. The novel sink according to claim 7, wherein the sink flat further comprises a block disposed opposite to the water inlet hole, the block blocking water flowing out of the water inlet hole into the annular water flow channel or the annular water outlet.

9. The novel sink according to claim 8, wherein the block is formed between the flange panel and the insert portion, and a section line of the block in a direction of a centerline of the sink body is a convex arc-shaped curve or an inclined straight line.

10. The novel sink according to claim 1, wherein the flange panel is seamlessly welded to the sink wall.

11. A sink flusher, the sink flusher being annular and comprising:

an inner wall;

an outer wall, arranged on an outer side of the inner wall, an upper end of the outer wall being connected with an upper end of the inner wall, a lower end of the outer wall being separated from a lower end of the inner wall, the lower end of the inner wall extending beyond the lower end of the outer wall, and an annular water flow channel being formed between the inner wall and the outer wall; and a water inlet pipe, formed on the inner wall or the outer wall and communicated with the annular water flow channel.

12. The sink flusher according to claim 11, wherein a section line of the inner wall in a direction of a centerline of the sink flusher is an arc-shaped curve or an inclined straight line.

13. The sink flusher according to claim 11, wherein the lower end of the inner wall extends downward in a vertical direction; or in an extending direction, the lower end of the inner wall is gradually inclined towards a side where the outer wall is located.

14. A novel sink, comprising:

a sink body; and the sink flusher according to claim 11, wherein the inner wall and the outer wall of the sink flusher are both inserted into the sink body, and water in the annular water flow channel washes a side wall of the sink body.

15. The novel sink according to claim 14, wherein an annular mounting groove is provided at a top portion of the sink body, the inner wall and the outer wall of the sink flusher are both inserted into the annular mounting groove, the lower end of the inner wall extends through a bottom portion of the annular mounting groove, and an annular water outlet is formed between the inner wall and the side wall of the sink body.

* * * * *